US008743001B2

(12) United States Patent
Guler

(10) Patent No.: US 8,743,001 B2
(45) Date of Patent: Jun. 3, 2014

(54) MECHANICALLY STEERED REFLECTOR ANTENNA

(75) Inventor: Michael G. Guler, Dawsonville, GA (US)

(73) Assignee: EMS Technology, Inc., Norcross, GA (US)

( * ) Notice: Subject to any disclaimer, the term of this patent is extended or adjusted under 35 U.S.C. 154(b) by 334 days.

(21) Appl. No.: 12/882,884

(22) Filed: Sep. 15, 2010

(65) Prior Publication Data

US 2011/0063179 A1 Mar. 17, 2011

Related U.S. Application Data

(60) Provisional application No. 61/242,411, filed on Sep. 15, 2009.

(51) Int. Cl.
*H01Q 3/12* (2006.01)
*H01Q 3/00* (2006.01)
*H01Q 19/10* (2006.01)

(52) U.S. Cl.
USPC ..... 343/761; 343/766; 343/839

(58) Field of Classification Search
USPC ..... 343/757, 761, 766, 765, 839
See application file for complete search history.

(56) References Cited

U.S. PATENT DOCUMENTS

| | | | | |
|---|---|---|---|---|
| 2,524,292 | A * | 10/1950 | Iams et al. | 342/158 |
| 3,343,171 | A | 9/1967 | Goodman | |
| 4,353,073 | A | 10/1982 | Brunner et al. | |
| 4,388,623 | A * | 6/1983 | Crook et al. | 343/709 |
| 4,862,185 | A * | 8/1989 | Andrews et al. | 343/761 |
| 5,398,035 | A | 3/1995 | Densmore et al. | |
| 5,565,879 | A | 10/1996 | Lamensdorf | |
| 5,686,923 | A | 11/1997 | Schaller | |
| 6,169,522 | B1 * | 1/2001 | Ma et al. | 343/853 |
| 6,768,468 | B2 | 7/2004 | Crouch et al. | |
| 6,836,247 | B2 * | 12/2004 | Soutiaguine et al. | 343/700 MS |
| 6,980,170 | B2 * | 12/2005 | Geen | 343/781 CA |
| 7,192,146 | B2 | 3/2007 | Gross et al. | |
| 2007/0152897 | A1 * | 7/2007 | Zimmerman et al. | 343/757 |
| 2009/0033575 | A1 * | 2/2009 | Dybdal et al. | 343/757 |

FOREIGN PATENT DOCUMENTS

| | | |
|---|---|---|
| DE | 102008011350 | 9/2009 |
| EP | 0732766 | 3/1996 |

OTHER PUBLICATIONS

John L. Volakis, "Antenna Engineering Handbook", 2007, Mc Graw-Hill, Fourth Edition, pp. 1-25 through 1-26.*

Eric L. Holzman, "Pillbox Antenna Design for Millimeter-Wave Base-Station Applications", "IEEE Antennas and Propagation Magazine", Feb. 2003, IEEE, vol. 45 No. 1, pp. 27-29.*

(Continued)

*Primary Examiner* — Hoang V Nguyen
*Assistant Examiner* — Patrick Holecek
(74) *Attorney, Agent, or Firm* — Fogg & Powers LLC

(57) ABSTRACT

A rotatable reflector antenna system that supports on-the-move communications to and from a mobile land, airborne, or maritime vehicle with a remote communication device, such as a geostationary satellite. The antenna system can include a pillbox antenna, a line feed antenna, or an array of horn antennas that convey electromagnetic waves between a transceiver (transmitter and/or receiver) and a reflector. The reflector may be embodied as a singly curved, parabolic cylinder reflector coupled to support members in a manner that enables the reflector to rotate with respect to the antenna. The reflector can rotate in a first direction, such as an elevation rotation, and the entire antenna system including the reflector can be mounted to a turntable or other rotatable platform that rotates in a second direction, such as an azimuth rotation.

31 Claims, 9 Drawing Sheets

(56) References Cited

OTHER PUBLICATIONS

John L. Volakis, "Antenna Engineering Handbook", 2007, McGraw-Hill, Fourth Edition, pp. 1-25 through 1-26.*

John L. Volakis, "Antenna Engineering Handbook", 2007, McGraw-Hill, Fourth Edition, pp. 1-25 through 1-26 and pp. 15-2 through 15-19.*

Eric L. Holzman, "Pillbox Antenna Design for Millimeter-Wave Base-Station Applications", "IEEE Antennas and Propagation Magazine", Feb. 2003, IEEE, vol. 45, No. 1, pp. 27-29.*

International Preliminary Examining Authority, "International Preliminary Report on Patentability", "from Foreign Counterpart of U.S. Appl. No. 12/882,884", Mar. 20, 2012, pp. 1-5.

International Searching Authority, "International Search Report", "from Foreign Counterpart of U.S. Appl. No. 12/882,884", Nov. 5, 2010, p. 1.

European Patent Office, "Office Action", "from Foreign Counterpart of U.S. Appl. No. 12/882,884", May 24, 2013, pp. 1-8, Published in: EP.

European Patent Office, "European Search Report", "from Foreign Counterpart of U.S. Appl. No. 12/882,884", May 3, 2013, pp. 13, Published in: EP.

* cited by examiner

MECHANICALLY STEERED REFLECTOR ANTENNA

RELATED PATENT APPLICATION

This non-provisional patent application claims priority under 35 U.S.C. §119 to U.S. Provisional Patent Application No. 61/242,411, entitled, "Low Cost, Mechanically Steered, Reflector Antenna," filed Sep. 15, 2009, the entire contents of which are hereby fully incorporated herein by reference.

TECHNICAL FIELD

The present disclosure relates generally to reflector antennas, and more particularly to a rotatable reflector antenna system having a mechanically steered reflector that rotates about an axis and a method for identifying a location for the axis.

BACKGROUND

Parabolic antennas sometimes provide on-the-move communications between a mobile vehicle, such as a land mobile vehicle or an aircraft, and another vehicle, satellite or fixed ground station. Parabolic reflector antennas typically include a parabolic shaped reflector and one or more feed horns that are directed at the reflector. Each feed horn conveys electromagnetic waves between the reflector and a transceiver that is typically housed inside the vehicle upon which the antenna is mounted. The parabolic shaped reflector focuses planar electromagnetic waves incident on the reflector and perpendicular with an axis to a focal point, where the feed horn's aperture is typically located. The parabolic reflector also transforms spherical electromagnetic waves output by the feed horn(s) into a plane wave propagating as a collimated beam.

In order for the parabolic antenna to communicate with a remote device, the antenna beam is pointed at the remote device. That is, the reflector is oriented such that the electromagnetic waves transmitted by the remote device are focused into the aperture of the feed horn(s) and the collimated beam formed by the reflector is directed at the remote device. For on-the-move communications, the antenna beam is continuously steered to compensate for the vehicle's changing orientation. For example, if the parabolic antenna is mounted on an aircraft, the parabolic antenna would be steered to account for the aircraft banking.

One conventional way to steer the antenna beam is to mount the entire parabolic antenna on a two-axis motorized positioning system, such as an elevation-over-azimuth positioner. However, two-axis motorized positioning systems involve two separate rotary joints and/or flexible cables to provide a path for signals to be conveyed between the feed horn(s) and the transceiver. For example, the parabolic antenna may be mounted on an elevation positioner of an elevation-over-azimuth positioner. A first rotary joint would route signals between the transceiver and the azimuth turntable and a second rotary joint would route the signals between the azimuth turntable and the parabolic antenna. These hardware components can be costly and lead to more bulky and complex antenna systems and preclude their use in many applications.

Thus, a need exists in the art for systems and methods that overcome one or more of the above-described limitations.

SUMMARY

The invention facilitates an antenna system having a mechanically steered reflector and line source feed antenna, such as an array of waveguide horns, an array of feed horns, or a pillbox antenna, having an aperture directed at the reflector. The reflector can include a cylindrical reflector having a curved reflector surface, such as a parabolic shaped reflective surface, that focuses electromagnetic waves incident on the reflector surface at a focal line. The reflective surface can also transform electromagnetic waves emanated from the focal line into a plane wave propagating as a collimated beam. The aperture of the line source feed antenna can be positioned at the focal line and aimed at the reflector to enable the line source feed antenna to convey electromagnetic waves between the reflector and a transceiver (transmitter and/or receiver).

The reflector can be rotatably coupled to a support structure that allows the reflector to rotate in a first direction or in a first plane, such as in elevation. The line source feed antenna can remain in a fixed position relative to the rotation of the reflector in the first direction or first plane. The antenna system, including the line source feed antenna and the reflector, can be mounted on a motorized turntable or other mechanism that rotates the antenna system in a second direction or second plane. The second direction or second plane can be perpendicular to the first plane, such as in azimuth.

An aspect of the present invention provides an antenna system. The antenna system can include a cylindrical reflector having a reflective surface and extending lengthwise along a first axis. The antenna system can also include an antenna feed element having an aperture directed at the reflective surface. A mechanical joint can rotate the cylindrical reflector about a second axis that is substantially parallel to the first axis to steer an electromagnetic beam output by the at least one feed element in a direction perpendicular to the first or second axis.

Another aspect of the present invention provides an antenna system. The antenna system can include a parabolic cylinder reflector having a reflective surface and extending lengthwise along a first axis. The antenna system can also include a line source feed antenna having an aperture pointed at the reflective surface and extending lengthwise along the first axis to illuminate a substantial portion of the reflective surface. The antenna system can also include a means for rotating the parabolic cylinder reflector about a second axis that is substantially parallel to the first axis to steer an electromagnetic beam output by the line source feed antenna in a direction perpendicular to the first or second axis.

Yet another aspect of the present invention provides a method for identifying an axis for rotating a reflector relative to an antenna feed element having an aperture directed at a reflective surface of the reflector. The method can include evaluating performance of the reflector at multiple reflector rotational axes. Each evaluation can include (a) positioning the reflector on one of the plurality of rotation axes; (b) rotating the reflector into a position to direct an electromagnetic beam in a direction; (c) emanating an electromagnetic beam in the direction; (d) obtaining characteristics of the emanated beam; and repeating (a) through (d) for multiple beam directions. One of the reflector rotational axes having improved performance relative to other ones of the reflector rotational axes can be selected based on the obtained characteristics.

Yet another aspect of the present invention provides a computer program product for identifying an axis for rotating a reflector relative to an antenna feed element having an aperture directed at a reflective surface of the reflector. The computer program product can include a computer-readable storage medium having computer-readable program code embodied therein. The computer-readable program code can include computer-readable program code for evaluating performance of the reflector at multiple reflector rotational axes. Each evaluation can include (a) simulating an electromagnetic beam emanated by the reflector in each of a plurality of reflector positions along one of the reflector rotational axes, each reflector position for directing the electromagnetic beam in a direction; (b) estimating characteristics of the simulated beam; and (e) repeating (a) and (b) for a plurality of beam directions. The computer-readable program code can also include computer-readable program code for identifying one of the reflector rotational axes having improved performance relative to other ones of the reflector rotational axes based on the estimated characteristics.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
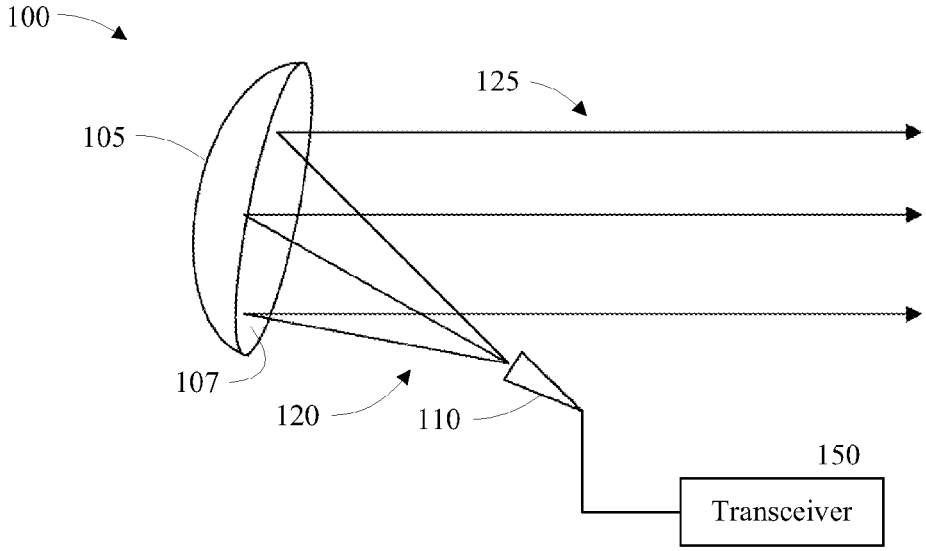
FIG. 1 is a diagram depicting an offset-fed parabolic reflector antenna system, in accordance with certain exemplary embodiments.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles.

DETAILED DESCRIPTION OF THE EXEMPLARY EMBODIMENTS

Exemplary embodiments provide a rotatable reflector antenna system. In one exemplary embodiment, the antenna system includes an antenna feed, such as a pillbox antenna, a line feed, or an array of waveguide horns or feed horns, that conveys electromagnetic waves between a transceiver (transmitter and/or receiver) and a reflector that is positioned in front of the antenna feed's aperture. The reflector may be embodied as a cylindrical reflector, such as a singly curved, parabolic cylindrical reflector, that is rotatably coupled to one or more support members such that the reflector can rotate in a plane perpendicular to the cylinder's axis, while the antenna feed remains fixed relative to this rotation. The reflector can rotate in a first plane, such as an elevation rotation, and the entire antenna system, including the reflector and antenna feed, can be mounted on a turntable or other rotatable platform that rotates in a second plane, such as an azimuth rotation. The combined rotational capabilities of the antenna system supports on-the-move communications to and from a mobile land, airborne, or maritime vehicle with a remote communication device, such as a geostationary satellite. To support on-the-move communications, the antenna system and/or the reflector rotate to compensate for movements of the vehicle (or other object) that the antenna system is attached to.

Although the exemplary embodiments are described largely in terms of an antenna system mounted on a mobile vehicle and communicating with a geostationary device or fixed platform, the antenna system may also be mounted on a geostationary object or other fixed platform for communication with a mobile device. In addition, the antenna system can be used to communicate from a mobile vehicle to another mobile device, such as another antenna mounted on another mobile vehicle.

The following description of exemplary embodiments refers to the attached drawings. Any spatial references herein such as, for example, "upper," "lower," "above," "below," "rear," "between," "vertical," "angular," "beneath," "top," "bottom," "left," "right," etc., are for the purpose of illustration only and do not limit the specific orientation or location of the described structure.

Turning now to the drawings, in which like numerals represent like (but not necessarily identical) elements throughout the figures, exemplary embodiments of the present invention are described in detail. FIG. 1 is a diagram depicting an offset-fed parabolic reflector antenna system 100, in accordance with certain exemplary embodiments. Referring to FIG. 1, the parabolic reflector antenna system 100 includes a feed horn 110 that conveys electromagnetic waves 120 between a doubly curved, parabolic reflector 105 and a transceiver (transmitter and/or receiver) 150.

Parabolic reflectors, such as the doubly curved, parabolic reflector 105, are reflective devices used to collect or project energy, such as electromagnetic waves 120, light, or sound. The parabolic reflector 105 includes a metallic surface 107 formed or shaped into a circular paraboloid and truncated in a circular rim. The parabolic reflector 105 can transform an incoming plane wave (or parallel electromagnetic rays) into a spherical wave converging toward a focal point. Conversely, the parabolic reflector 105 can transform a spherical wave generated by the feed horn 110, which is located at the focal point and aimed at the parabolic reflector 105, into a plane wave propagating as a collimated beam 125. Thus, the parabolic antenna system 100 can be used to collect electromagnetic waves that are incident on the surface 107 and to emanate a collimated beam 125 of electromagnetic energy.

Figure 2:
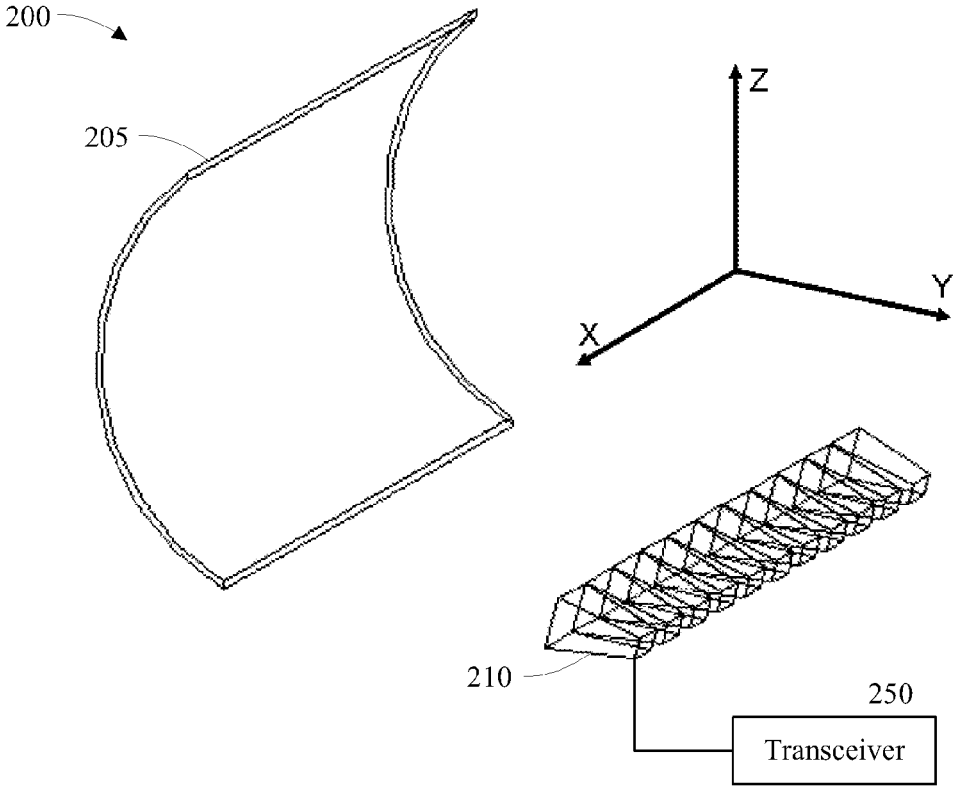
FIG. 2 is a diagram depicting a parabolic cylindrical reflector antenna system, in accordance with certain exemplary embodiments.

An improvement to the parabolic antenna system 100 for on-the-move applications is illustrated in FIG. 2. In particular, FIG. 2 is a diagram depicting a parabolic cylinder reflector antenna system 200 having a singly curved, parabolic cylinder reflector 205 positioned in front of line source feed antenna 210 having an array of feed horns. The line source feed antenna 210 conveys electromagnetic waves (not shown) between the reflector 205 and a transceiver (transmitter and/or receiver) 250.

In contrast to the doubly curved, parabolic reflector 105 illustrated in FIG. 1, the singly curved, parabolic cylinder reflector 205 is parabolic in one plane (the y-z plane) rather than two. The planes perpendicular to the y-z plane of the singly curved parabolic reflector 205 can be straight. Instead of feeding the reflector 205 with a single feed horn, the line source feed antenna 210 is used to illuminate the reflector 205. To illuminate the entire surface (or a substantial portion of the surface) of the reflector 205, each feed horn in the line source feed antenna 210 can illuminate the height of the reflector 205 and the line feed source antenna 210 can extend along the width (or a substantial portion of the width) of the reflector 205 to illuminate the width of the reflector 205.

One benefit of the parabolic cylinder reflector antenna system 200 over the parabolic antenna system 100 illustrated in FIG. 1 is that the singly curved, parabolic cylinder reflector 205 can be significantly less expensive to fabricate and support than the doubly curved, parabolic reflector 105. Additionally, this configuration can be designed with a low-profile, or low height-to-width aspect ratio, making it preferred for mobile or on-the-move applications.

Figure 3:
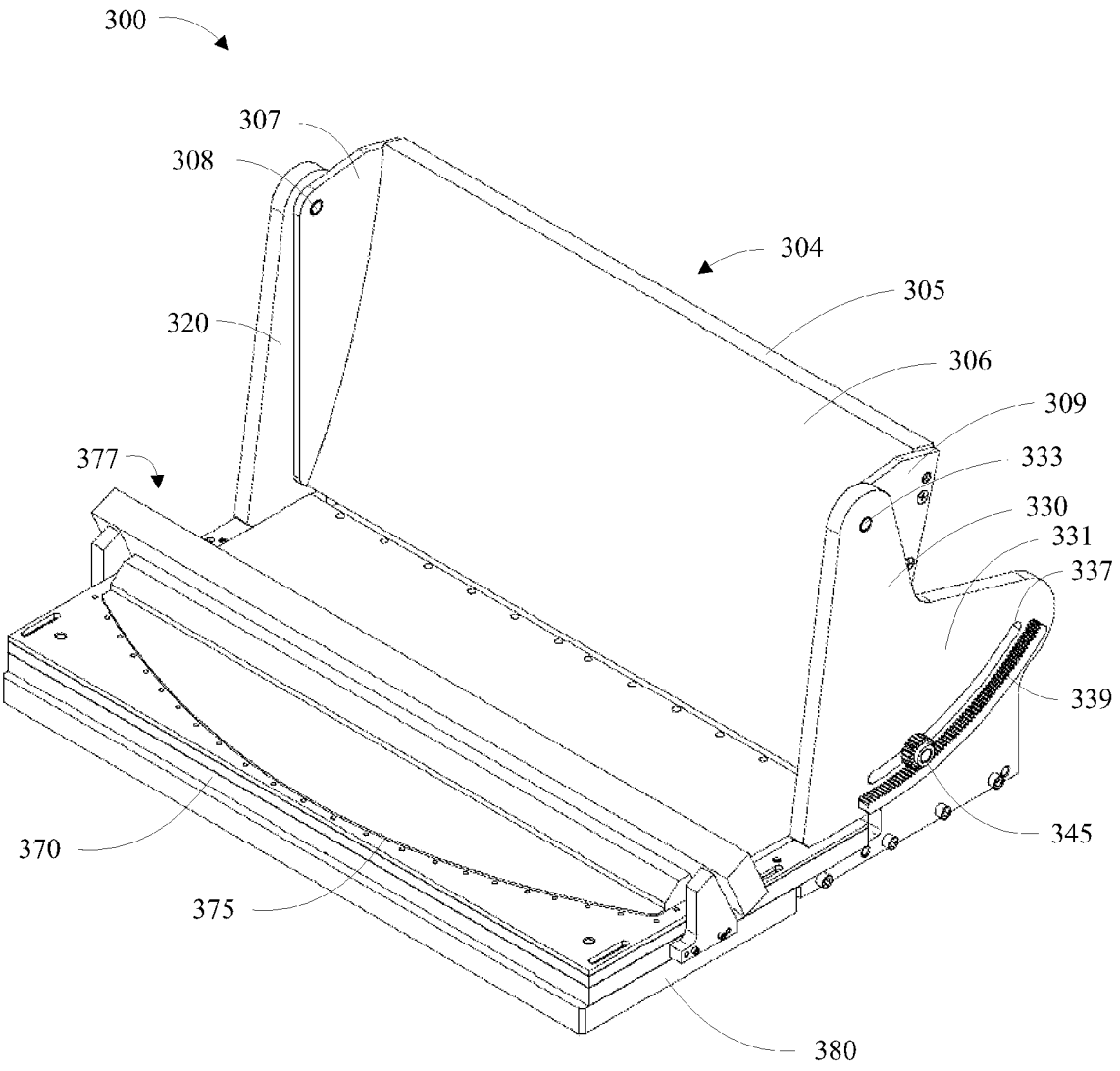
FIG. 3 is a front view of an antenna system having a rotatable cylindrical reflector, in accordance with certain exemplary embodiments.
Figure 4:
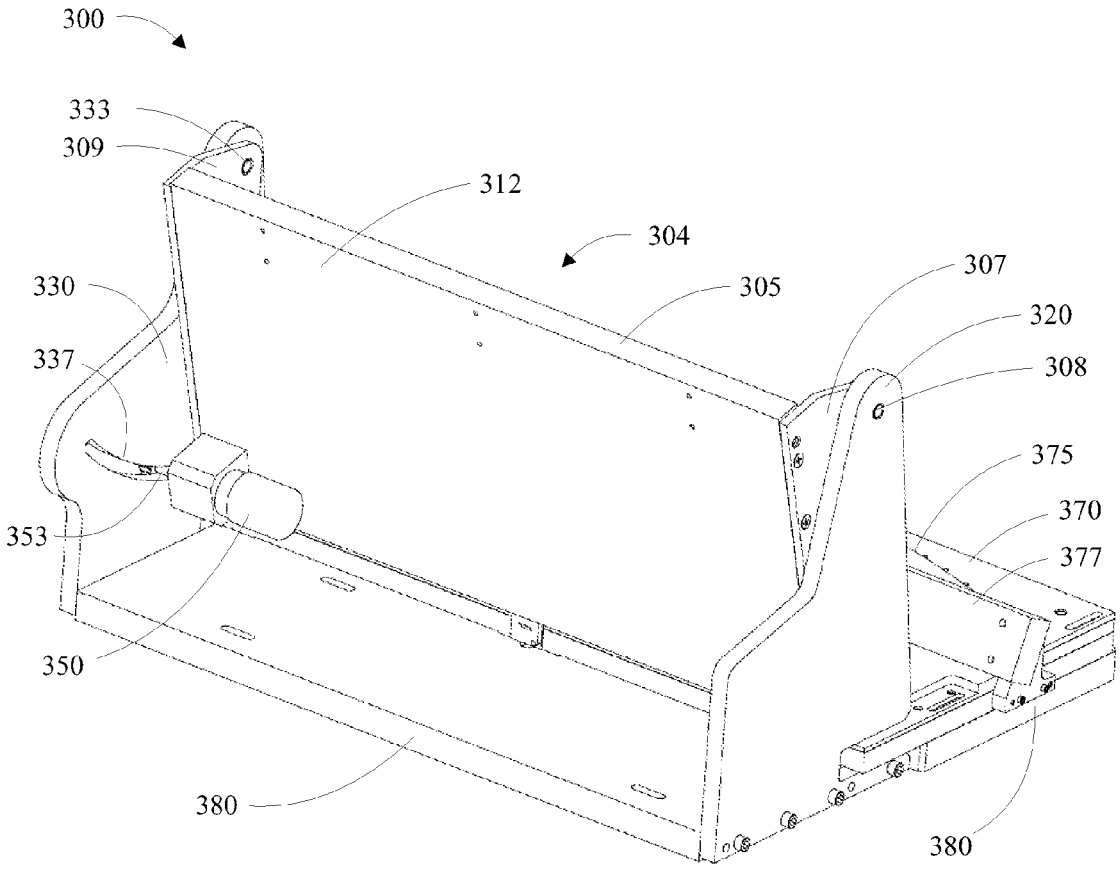
FIG. 4 is a rear view of the antenna system of FIG. 3, in accordance with certain exemplary embodiments.

FIGS. 3 and 4 depict an antenna system 300 having a rotatable cylindrical reflector 305, in accordance with certain exemplary embodiments. FIG. 3 provides a front view of the exemplary antenna system 300 and FIG. 4 provides a rear view of the antenna system 300.

Referring to FIGS. 3 and 4, the exemplary antenna system 300 includes a reflector assembly 304 and a line source feed antenna 370. In the illustrated embodiment, the line source feed antenna 370 is embodied as a pillbox antenna, which is discussed in further detail below in connection with FIG. 5. In certain alternative embodiments, the line source feed antenna 370 can include an array of waveguide horns or an array of feed horns in place of (or in addition to) the pillbox antenna.

The reflector assembly 304 and the line source feed antenna 370 are coupled to a platform 380. The platform 380 can be mounted on a motorized turntable or other rotatable object or device. For example, the platform 380 can be mounted on a turntable on the upper (or lower) fuselage of an aircraft, on the roof of a land mobile vehicle, or on a maritime vehicle. In these examples, the platform 380, and thus the components mounted thereon, can be rotated in azimuth 360 degrees.

The antenna system 300 includes two reflector support members 320 and 330 that are attached to and protrude upward from the platform 380. The reflector support members 320 and 330 are used to rotatably couple the reflector assembly 304 to the platform 380. In the illustrated embodiment, the reflector assembly 304 includes a reflector 305 attached on either horizontal side to support members 307 and 309. The support member 307 is rotatably coupled to the reflector support member 320 at a pivot point 308. Similarly, the support member 309 is rotatably coupled to reflector support member 330 at pivot point 333. The pivot points 308 and 333 define an axis of rotation ("reflector rotation axis") for the reflector assembly 304, and thus the reflector 305. That is, the reflector assembly 304 (and reflector 305) rotates about an axis that extends from pivot point 308 to pivot point 333. In this configuration, the reflector 305 is rotated in a direction perpendicular to the direction of rotation of the platform 380. Thus, if the platform 380 rotates in azimuth, the reflector 305 rotates in elevation.

The location of the pivot points 308 and 333, and thus the reflector rotation axis, can be configured based upon the application of the antenna system 300, the type of feed antenna used, and the configuration of the reflector 305 to provide an acceptable level of performance. An exemplary method for identifying the location of the pivot points 308 and 333 is described below in connection with FIGS. 9 and 10.

As best seen in FIG. 4, the antenna system 300 includes a motor 350 attached to a rear surface 312 of the reflector 305. The reflector support member 330 includes a hollow slot 337 having a curvature that matches the angle of rotation of the reflector assembly 304. The slot 337 provides clearance for a motor shaft 353 that extends through the slot 337. At the end of the motor shaft 353 is a gear 345 having teeth that mesh with a rack 339 attached or otherwise coupled to an outside surface 331 of the reflector support member 330. As the motor 350 rotates the gear 345 via the shaft 353, the gear 345 moves along the rack 339 causing the reflector assembly 304 to rotate. The motor 350, gear 345, and rack 339 combination is one exemplary mechanism for rotating the reflector assembly 304. Another mechanism (not shown) can employ a mechanical device (e.g., a push rod) that pushes and/or pulls on the back side of the reflector 305 or reflector assembly 304 and causes the reflector assembly 304 to rotate. Another mechanism (not shown) can employ a motor fixed to the support member 330 that drives a shaft at the pivot point 333. The shaft can be fixed to the reflector assembly 304 with its bearing concentric with the pivot point 333. The shaft can be driven directly by the motor, or by a gear or belt system.

The motor 350 and/or the turntable (or other device) that the platform 380 is coupled to can be operated by a control device located in a remote location. For example, the motor 350 and a motor that drives the turntable may each be electrically coupled to a control device that can selectively control whether the motors are activated and the direction of rotation for the motors. The control device may be located inside a vehicle that the antenna system 300 is mounted on. For example, in an aircraft application, the control device may be located inside the aircraft's fuselage and protected from the environment.

In the illustrated embodiment, the reflector 305 has a metallic surface 306 formed or shaped into a singly curved, parabolic cylinder, similar to that of the reflector 205 illustrated in FIG. 2 and discussed above. In certain alternative embodiments, the reflector surface 306 may be curved in one plane, such as the vertical plane (or the y-z plane as illustrated in FIG. 2), but not necessarily parabolic, and straight in a second plane, such as the horizontal plane.

Because the reflector surface 306 is curved in one plane (the vertical plane) only, there are many feasibly methods for fabricating the reflector 305. One method includes fabricating a series of parabolic supports that form a backup structure for a thin metal plate. The thin metal plate can be shaped into a singly curved, parabolic cylinder as shown in FIGS. 2 and 3 and attached to the supports. Another method for fabricating the reflector includes cladding or coating one side of a flexible dielectric material, such as a circuit board, or a flexible plastic with a metal and shaping the material into a singly curved, parabolic cylinder. Many other methods are feasible, as would be appreciated by one of ordinary skill in the art having the benefit of the present disclosure.

Figure 5:
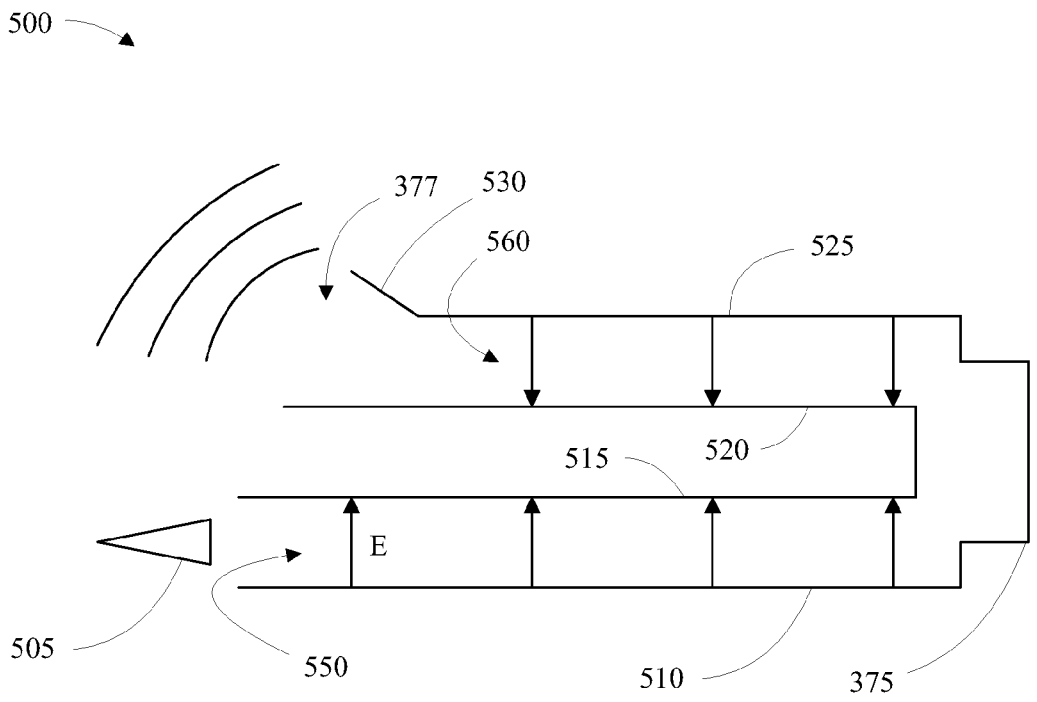
FIG. 5 is a cross-sectional view of a pillbox antenna, in accordance with certain exemplary embodiments.

As discussed above, the line source feed antenna 370 is embodied as a pillbox antenna. A pillbox antenna is a waveguide-fed antenna having a cylindrical reflector sandwiched between two parallel plates. The parabolic curvature of the cylindrical reflector is denoted by reference numeral 375. A side cross-sectional view of an exemplary pillbox antenna 500 is depicted in FIG. 5. Referring now to FIGS. 3-5, the pillbox antenna 500 includes a waveguide horn 505 directed at the cylindrical reflector 375 between two parallel plates 510 and 515. The waveguide horn 505 transmits a spherical wave 550 that propagates between the two parallel plates 510 and 515 until the spherical wave 550 reaches the cylindrical reflector 375. The cylindrical reflector 375 transforms the spherical wave into a plain wave 560 in one direction, such as the azimuth direction, that propagates away from the cylindrical reflector 375 toward the aperture 377 between two parallel plates 520 and 525. The aperture 377 includes an angled member 530 that allows the wave 560 to launch into free space toward the reflector surface 306.

If the antenna system 300 is oriented such that the reflector 305 rotates in elevation, the cylindrical reflector 375 of the pillbox antenna 370 transforms the spherical wave 550 into a plain wave 560 in the azimuth direction. When the wave 560 reflects from the reflector surface 306, the reflected wave is a plain wave in both the azimuth direction and the elevation direction. Thus, the resultant wave is similar to that of a pencil beam.

As discussed above, the antenna system 300 can be mounted on a motorized turntable or other object attached to a mobile land, air, or maritime vehicle to support on-the-move communication. The motorized turntable can provide a rotation in a first direction, for example the azimuth direction, and the reflector 305 can rotate in a second direction perpendicular to the first direction, such as the elevation direction. Thus, the entire antenna system 300 can rotate in azimuth to provide complete hemispherical coverage about a vehicle.

The antenna system 300 simplifies the elevation beam positioning, by keeping the line source feed antenna 370 (e.g., pillbox antenna, array of waveguide horns, array of feed horns, etc.) in a fixed position with respect to elevation. This also alleviates the need for a rotary joint or flex cable for elevation beam steering.

Because the reflector 305 is rotated in elevation while the pillbox antenna 370 remains stationary in elevation, the feed/reflector system (i.e., line source feed antenna 370 and reflector 305) can degrade from a perfectly focused system at certain reflector positions. For example, the feed/reflector system may be configured to be perfectly focused (or near perfectly focused or focused at an acceptable level) when the reflector 305 is rotated to direct electromagnetic beams at an angle of 62 degrees in elevation (and to focus incoming electromagnetic beams traveling at 62 degrees in elevation). If the reflector 305 is rotated to direct electromagnetic beams at an angle other than 62 degrees, the focus of the feed/reflector system may be degraded.

Figure 6:
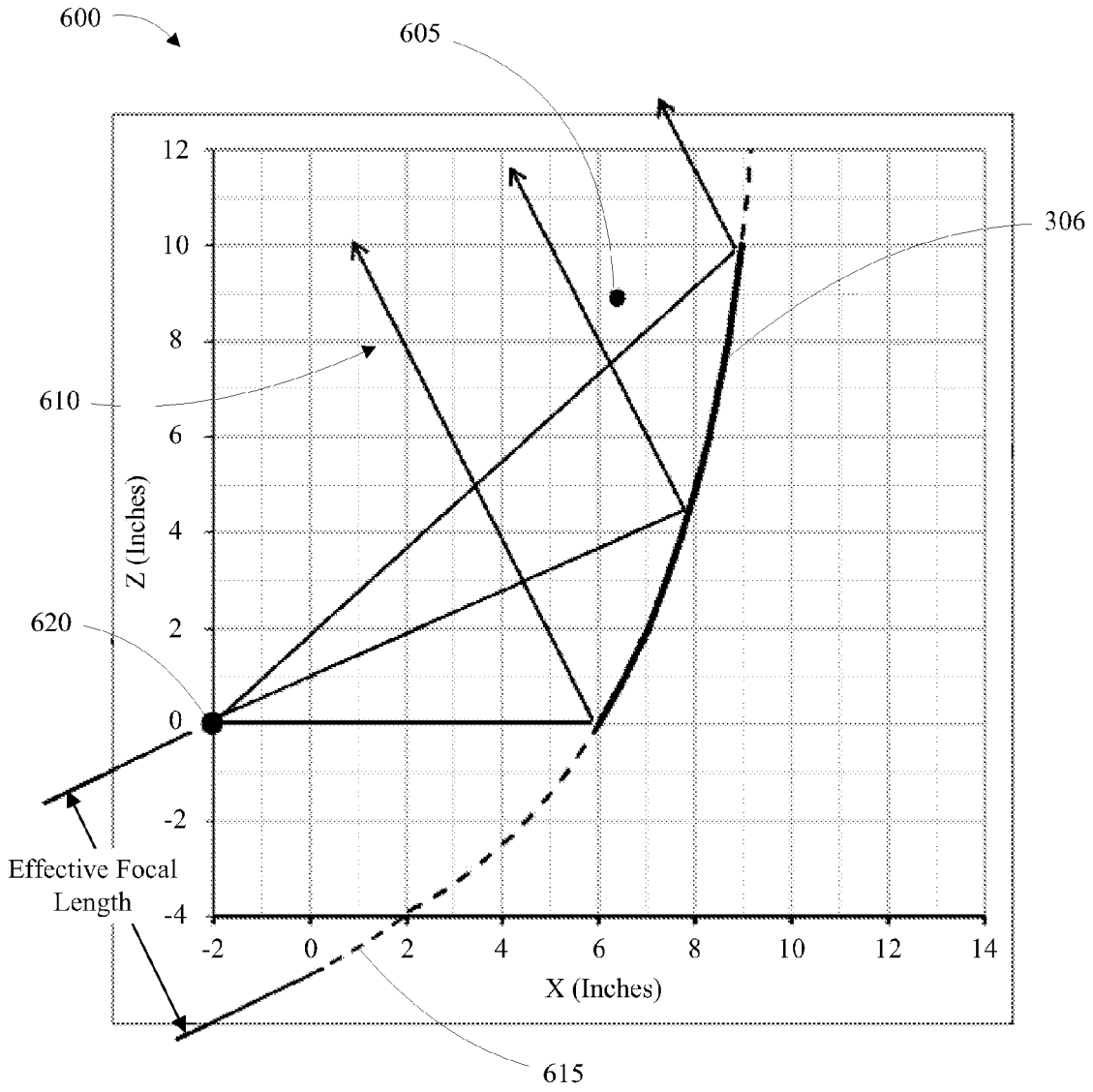
FIG. 6 is a diagram depicting a plot of a parabolic cylinder reflector projecting electromagnetic beams, in accordance with certain exemplary embodiments.
Figure 7:
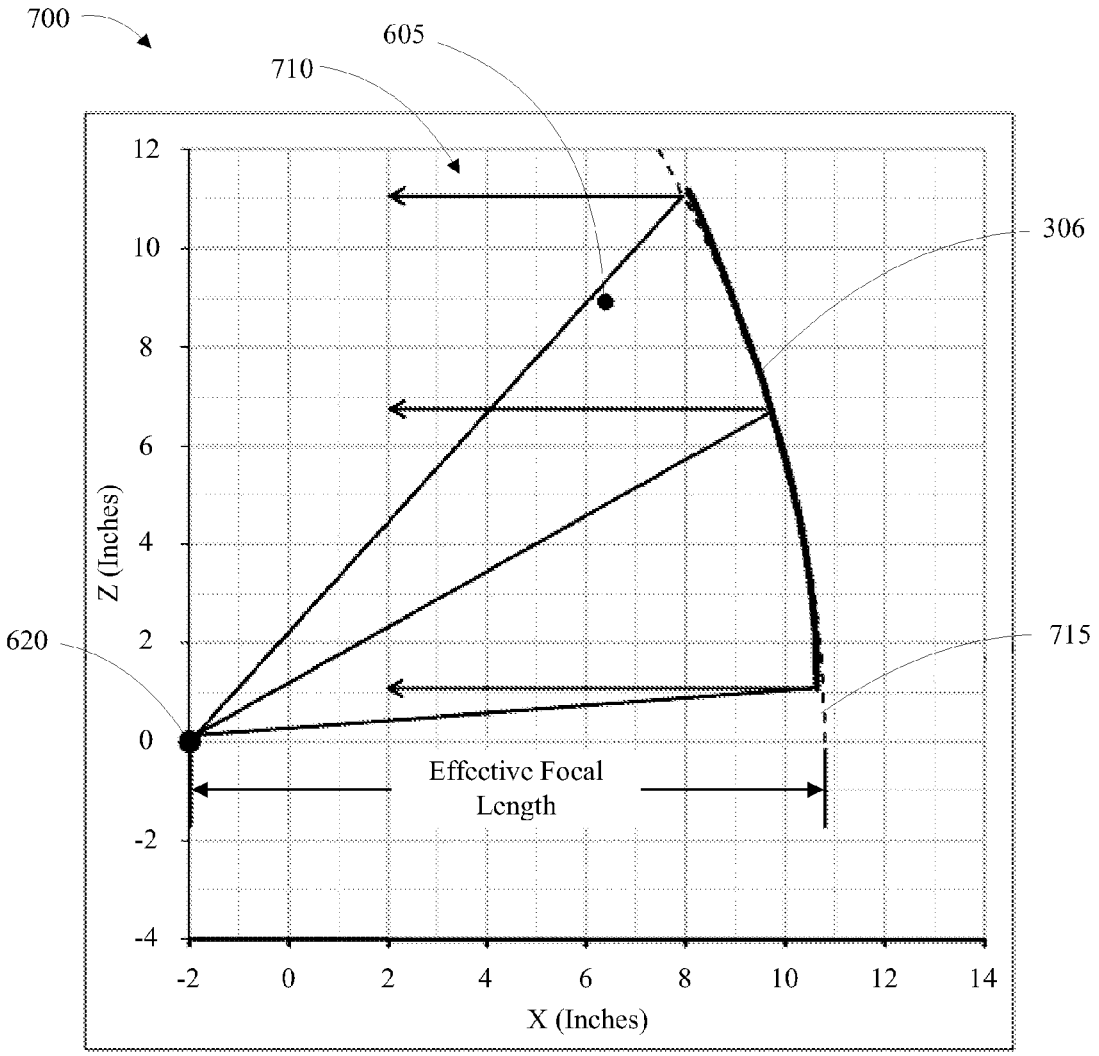
FIG. 7 is a diagram depicting a plot of a parabolic cylinder reflector projecting electromagnetic beams, in accordance with certain exemplary embodiments.
Figure 8:
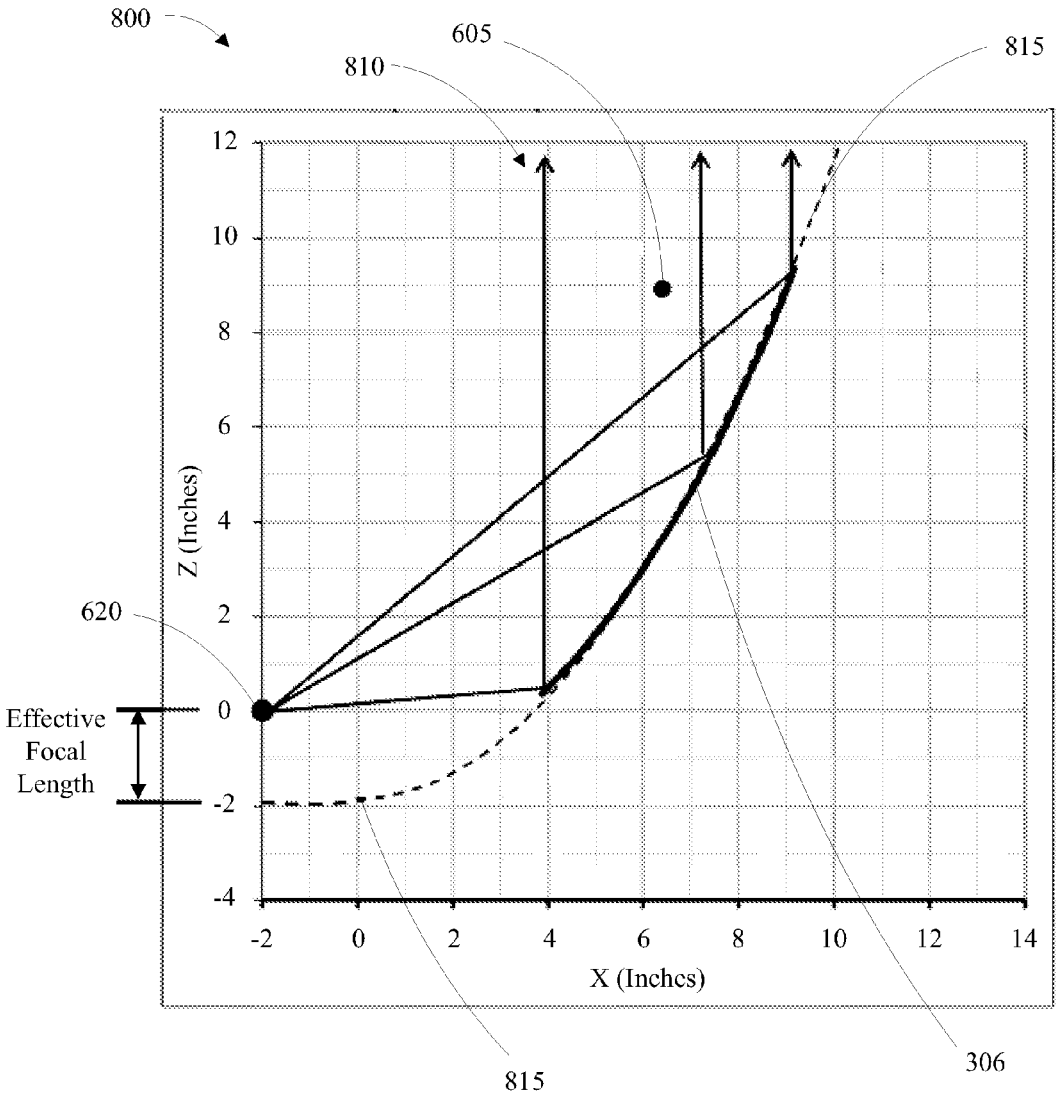
FIG. 8 is a diagram depicting a plot of a parabolic cylinder reflector projecting electromagnetic beams, in accordance with certain exemplary embodiments.

For example, FIGS. 6-8 are diagrams illustrating how the reflector 305 of the antenna system 300 can be rotated to direct electromagnetic beams transmitted by the line source feed antenna 370 in several different directions. In particular, FIG. 6 depicts the reflector surface 306 rotated in a position to direct electromagnetic beams at an angle of 62 degrees in elevation; FIG. 7 depicts the reflector surface 306 rotated in a position to direct electromagnetic beams at an angle of 0 degrees in elevation; and FIG. 8 depicts the reflector surface 306 in a position to direct electromagnetic beams at an angle of 90 degrees in elevation.

Referring to FIGS. 3, 4, and 6-8, let the antenna system 300 be configured to provide perfect or near perfect focus for beam directions of 62 degrees in elevation. That is, when the reflector surface 306 is rotated about a pivot point 605 for a 62 degree beam direction, the focus of the feed/reflector system is perfect, near perfect, or at an acceptable level. A dashed line 615 in FIG. 6 illustrates the ideally focused optics for a beam direction 610 of 62 degrees. That is, the dashed line 615 indicates the curve of an ideal reflector surface 306 that focuses incoming electromagnetic waves at an angle of 62 degrees in elevation onto focal point 620 perfectly or near perfectly. In this illustration, the dashed line 615 overlays precisely with the reflector surface 306 and the feed/reflector system has an effective focal length of "F."

FIG. 7 illustrates the reflector surface 306 rotated about the pivot point 605 for a beam direction 710 of 0 degrees in elevation. A dashed line 715 illustrates ideally focused optics for this beam direction 710. That is, the dashed line 715 indicates the ideal curve of a reflector surface that focus incoming electromagnetic waves at an angle of 0 degrees in elevation onto focal point 620 perfectly or near perfectly. The dashed line 715 is only slightly offset from the actual reflector surface 306 as the feed/reflector system is optimized or configured for the 62 degree beam direction. This slight offset can cause some degradation in focus for the feed/reflector system at this beam direction 710. A similar effect is shown in FIG. 8 which illustrates the reflector rotated about the pivot point 605 for a beam direction 810 of 90 degrees in elevation. A dashed line 815 depicting ideally focused optics for this beam direction 810 is also slightly offset from the actual reflector surface 306. This slight offset can cause some degradation in focus for the feed/reflector system at this beam direction 810. Also, in FIGS. 7 and 8, the effective focal length has changed with respect to focal length "F."

Certain aspects of the exemplary antenna system 300 can be configured to optimize or improve its radio frequency ("RF") communication capabilities and focusing capabilities for differing beam directions. One such improvement includes determining what elevation beam direction should have perfect, near perfect, or an acceptable focus. This may be based on the application of the antenna system 300 ("antenna application"). For example, the antenna system 300 may be used in an application requiring beam directions between 45 degrees and 65 degrees elevation. In such an antenna application, the starting elevation beam direction would likely be in that range.

Another aspect of the antenna system 300 that can be configured is the location of the reflector's rotation axis, and thus the pivot points 308 and 333. This reflector rotation axis is typically offset from the reflector surface 306 as shown in FIG. 3. Empirical analysis suggests that the reflector 305 should rotate about an axis that is in front of the reflector surface 306. As discussed in further detail in connection with FIGS. 9 and 10, multiple rotation axes can be evaluated for a given application to determine the location for the pivot points 308 and 333.

Additional aspects of the antenna system 300 that can be configured are the elevation pattern of the line source feed antenna 370 and the tilt angle of the line source feed antenna 370. These aspects can be modified and evaluated to determine appropriate settings.

Figure 9:
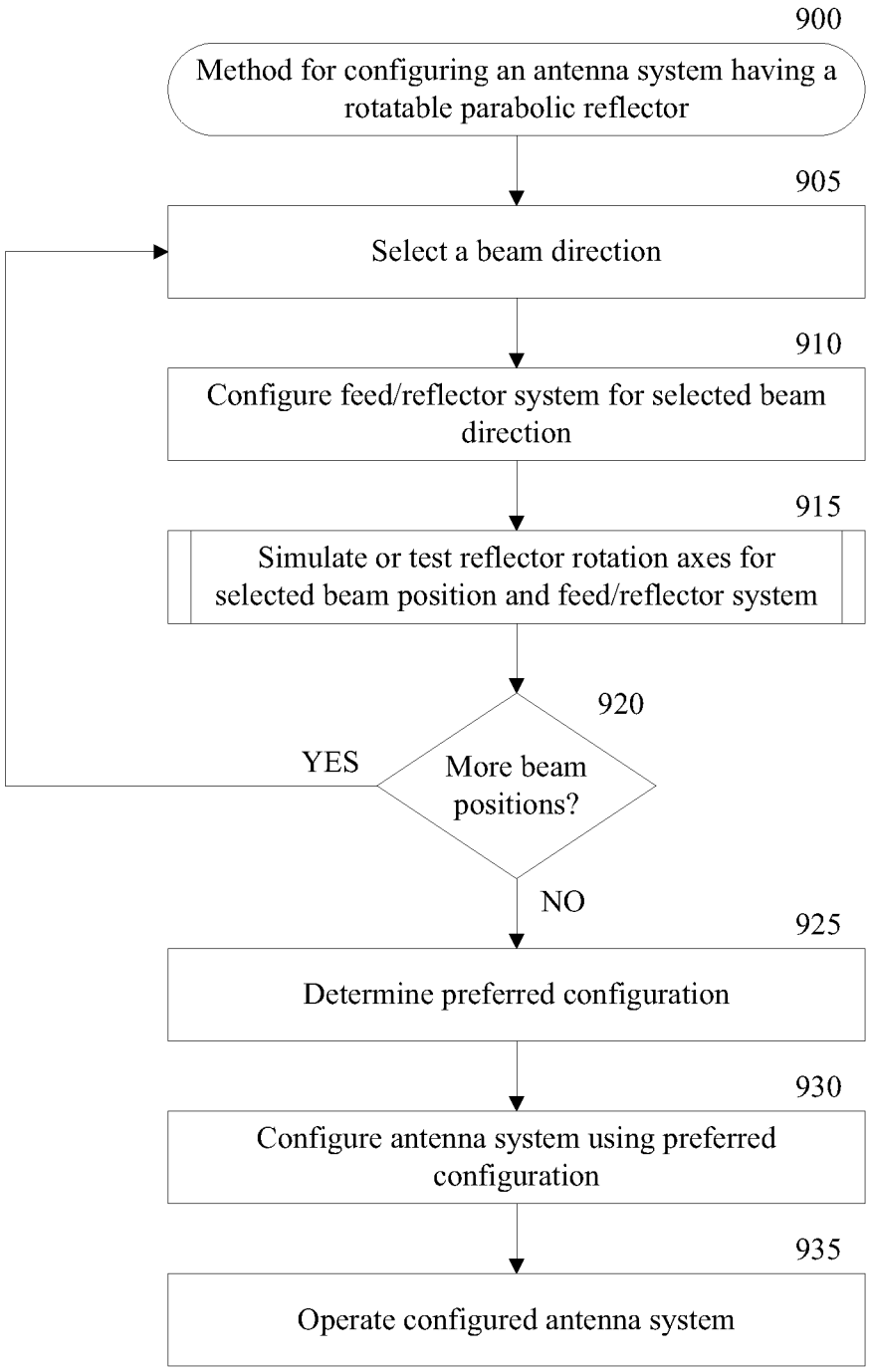
FIG. 9 is a flow chart depicting a method for configuring an antenna system having a rotatable cylindrical reflector, in accordance with certain exemplary embodiments.

FIG. 9 is a flow chart depicting a method 900 for configuring an antenna system 300 having a rotatable cylindrical reflector 305, in accordance with certain exemplary embodiments. The exemplary method 900 can be implemented via software simulation, actual testing, or a combination thereof. For ease of subsequent discussion, the blocks of the method 900 are discussed in terms of software simulation being performed by a simulation module executing on a computer system. In addition, for some blocks, a description of how an actual test may be performed is provided.

Referring to FIGS. 3, 4, and 9, in block 905, the simulation module selects a beam direction for configuring the feed/reflector system (i.e., line source feed antenna 370 and reflector 305). This selected beam direction corresponds to the beam direction at which the feed/reflector system will be configured for perfect, near perfect, an acceptable focus. In certain exemplary embodiments, the beam direction is selected based on the application for the antenna system 300. For example, if the antenna system 300 is going to be used to communicate with remote devices that vary between 30 degrees elevation and 60 degrees elevation from the reflector 305, the selected beam direction may be in that range.

In certain exemplary embodiments, in a first iteration of block 905, the selected beam direction may be in the middle of the range for the antenna application. Continuing the previous example, this first beam direction would be 45 degrees. In subsequent iterations of block 905, beam directions less than and greater than 45 degrees may be selected. The simulation module may evaluate the performance of the antenna system 300 at each beam direction and determine the next beam direction for evaluation based on the results. For example, if the results indicate better performance after the beam direction has been decreased, the simulation module may continue to decrease the beam direction until the performance peaks, no longer improves, or decreases.

In certain exemplary embodiments, in a first iteration of block 905, the selected beam direction may be at one end of the range. Continuing the previous example, the first selected beam direction may be 30 degrees elevation. Subsequent iterations may select higher values until the highest value is selected. For example, in each iteration, the beam direction may be increased by 1 degree in elevation.

The simulation module can also select beam directions outside the range for the antenna application and is not limited to this range. In certain exemplary embodiments, a range of beam directions may be selected for evaluation regardless of the antenna application. For example, the software module may evaluate the feed/reflector system using a list of predetermined or user configured beam directions.

In block 910, the simulation application configures the feed/reflector system for the beam direction selected in block 905. For example, the curvature of the reflector surface 306 and the focal length between the line source feed antenna 370 and the reflector surface 306 can be configured based on the selected beam direction.

In block 915, the simulation module simulates a reflector rotation axis for the feed/reflector system. The simulation module can iteratively simulate multiple rotation axes each using multiple beam directions and compute characteristics of the beam emanated by the reflector 305 for each simulation. The simulation module stores the characteristics in memory for evaluation in block 920. Alternatively, each beam direction for each rotation axis can be evaluated before moving to the next beam direction and/or rotation axis. Block 915 is discussed below in further detail in connection with FIG. 10.

In block 920, the simulation module conducts an inquiry to determine whether there are more beam directions to be simulated. In certain exemplary embodiments, a list of beam directions is to be simulated and subsequently evaluated. In such embodiments, the simulation module determines whether each beam direction in the list has been simulated. In certain exemplary embodiments the simulation module determines whether to simulate another beam direction based on the evaluation. In such embodiments, the inquiry of block 920 would occur after block 925. If the simulation module determines that another beam direction should be simulated, the method 900 follows the "YES" branch back to block 905 where another beam direction is selected. Otherwise, the "NO" branch is followed to block 925.

In block 925, the simulation module evaluates the stored characteristics to determine the best (or improved, preferred, or acceptable) feed/reflector configuration. In certain exemplary embodiments, this evaluation is based on the antenna application. For example, higher weight in the evaluation may be given to beam characteristics corresponding to commonly used beam directions for the antenna application. That is, if the antenna application calls for the antenna system 300 to commonly communicate within a range of 35 and 45 degrees in elevation, the performance of the antenna system 300 within this range may be given more weight. Exemplary characteristics of electromagnetic beams emanated by the antenna system 300 and evaluated in block 925 include gain (or directivity) and sidelobe levels. Other interrelated parameters can also be considered, such as spillover, taper efficiency, and beamwidth.

In block 930, the antenna system 300 is physically configured using the best (or improved, preferred, or acceptable) feed/reflector configuration selected in block 925. In block 935, the physically configured antenna system 300 is placed into operation. For example, the antenna system 300 may be mounted onto a vehicle for communication with a remote device, such as a geostationary satellite.

Although not shown, other aspects of the antenna system 300 can be evaluated in the method 900. For example, the height of the reflector 305, the feed pattern, and the feed pointing angle can be configured for the antenna system 300. Each configuration can be evaluated using the method 900 to determine a preferred or improved configuration.

Figure 10:
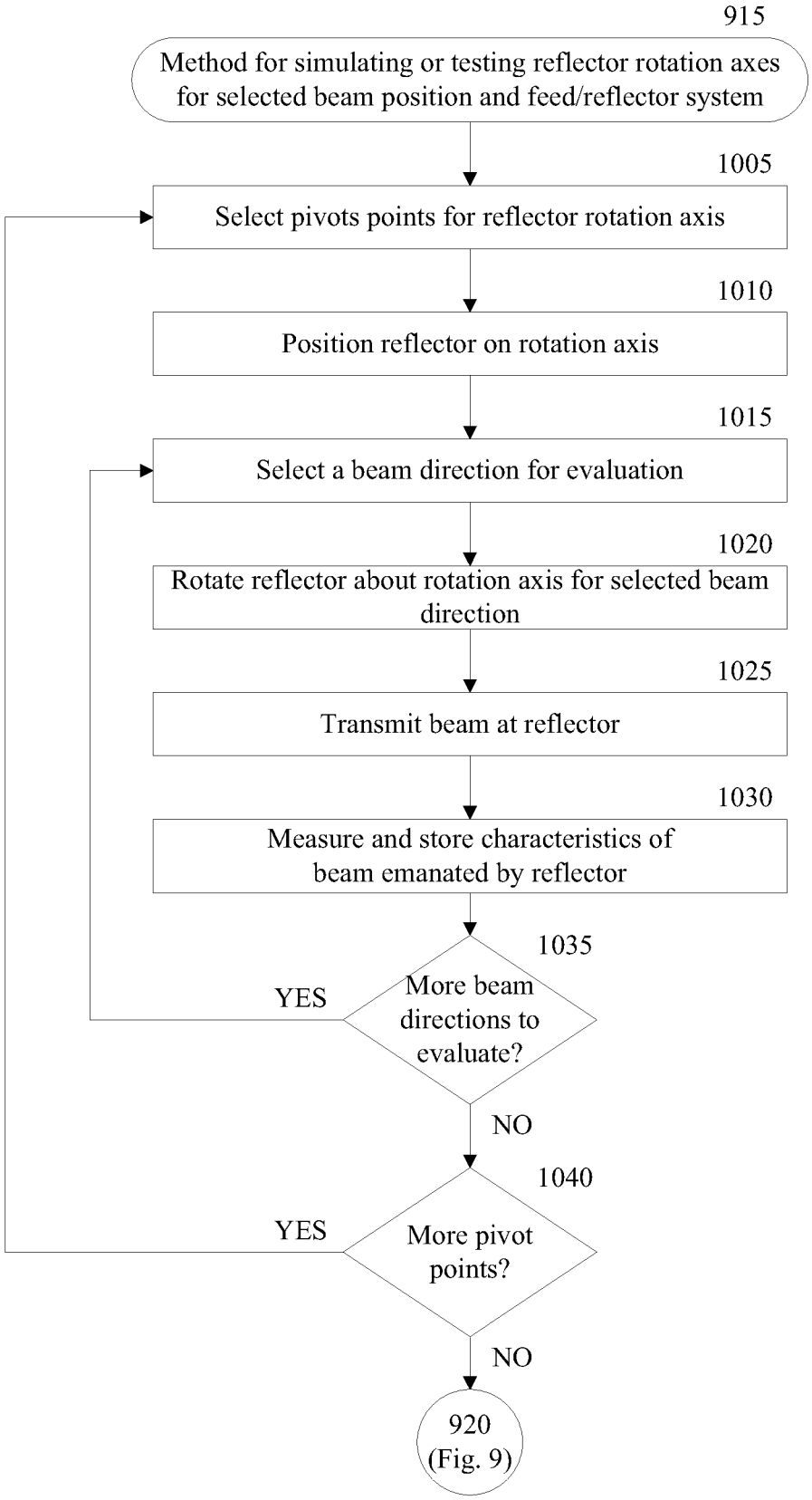
FIG. 10 is a flow chart depicting a method for simulating or testing reflector rotating axes for a rotatable cylindrical reflector, in accordance with certain exemplary embodiments.

FIG. 10 is a flow chart depicting a method 915 for simulating or testing reflector rotation axes for a rotatable cylindrical reflector 305, in accordance with certain exemplary embodiments, as referenced in block 915 of FIG. 9. Referring to FIGS. 3, 4, and 10, in block 1005, a reflector rotation axis and corresponding locations for pivot points 308 and 333 are selected for the feed/reflector system configured in block 910 and the beam direction selected in block 905 of FIG. 9. In certain exemplary embodiments, a predetermined set of reflector rotation axes may be simulated or tested in the method 915. In certain alternative embodiments, a first reflector rotation axis may be selected based on the selected beam direction and the antenna system 300 may be simulated and evaluated using the selected reflector rotation axis. In subsequent iterations, the reflector rotation axis may be adjusted based on the evaluation of a previous reflector rotation axis.

In block 1010, the simulation module simulates the reflector 305 being positioned on the reflector rotation axis selected in block 1005. If the antenna system 300 is being tested rather than simulated, the reflector 305 can be positioned on the selected reflector rotation axis using pivot points 308 and 333 corresponding to the selected reflector rotation axis.

In block 1015, the simulation module selects a beam direction for simulation. Although the feed/reflector system has been configured for perfect (or near perfect or acceptable) focus at a certain beam direction in block 910 of FIG. 9, other beam directions can be evaluated to assess the performance of the configured feed/reflector system at these other beam directions. For example, the feed/reflector system may be configured for perfect or near perfect focus at 45 degrees elevation. If the antenna system 300 will be operated in a range of 30-60 degrees elevation, some or all of these other beam directions can be evaluated to ensure acceptable performance throughout the range. The simulation module can select a beam direction from a predetermined list based on the antenna application or a user configured list of beam directions. In certain exemplary embodiments, this step 1015 can be substantially similar to or the same as step 905 of FIG. 9.

In block 1020, the simulation module simulates the rotation of the reflector 305 about the reflector rotation axis selected in block 1005 to direct a beam in the direction selected in block 1015. If the antenna system 300 is being tested rather than simulated, the reflector 305 can be rotated, for example using the motor 350, to direct a beam in the selected beam direction.

In block 1025, the simulation module simulates the transmission of an electromagnetic beam at the reflector surface 306. If the antenna system 300 is being tested rather than simulated, the line source feed antenna 370 may transmit a beam at the reflector surface 306.

In block 1030, the simulation module simulates characteristics of the beam that is reflected from the reflector surface 306 in the selected direction. If the antenna system is being tested rather than simulated, a standard antenna range measurement of the system 300 can be recorded for the current configuration. The characteristics simulated or measured can include, but are not limited to, gain (or directivity), sidelobe levels, spillover, taper efficiency, and beamwidth. The characteristics can be saved in memory for evaluation in block 925, as referenced in FIG. 9.

Although steps 1025 and 1030 have been discussed in terms of transmitting a beam from the line source feed antenna 370 and obtaining characteristics of the beam reflected off of the reflector surface 306, the steps 1025 and 1030 can, in addition or in the alternative, be performed by transmitting a beam at the reflector and obtaining characteristics of the focused beam at the focal point (aperture 377 of the line source feed antenna 370).

In block 1035, the simulation module conducts an inquiry to determine whether there is another beam direction to simulate for the current reflector rotation axis. For example, if a list of reflector rotation axes is being simulated, the simulation module determines whether each beam direction in the list has been simulated. If the simulation module determines that there are more beam directions to simulate, the method 915 follows the "YES" branch to block 1015 where another beam direction is selected. Otherwise, the method 915 follows the "NO" branch to block 1040.

In block 1040, the simulation module conducts an inquiry to determine whether another reflector rotation axis should be simulated. As described above, the simulation module may simulate a list of reflector rotation axes or determine reflector rotation axes for simulation based on the evaluation of a previous reflector rotation axis. If the simulation module determines to simulate another reflector rotation axis, the "YES" branch is followed to block 1005 where another reflector rotation axis is selected. Otherwise, the "NO" branch is followed to block 920, as referenced in FIG. 9.

Exemplary embodiments can be used with computer hardware and software that performs the methods and processing functions described above. The systems, methods, and procedures described herein can be embodied in a programmable computer, computer-executable software, or digital circuitry. The software can be stored on computer-readable media. For example, computer-readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays (FPGA), etc.

Although specific embodiments have been described above in detail, the description is merely for purposes of illustration. It should be appreciated, therefore, that many aspects described above are not intended as required or essential elements unless explicitly stated otherwise. Modifications of, and equivalent acts corresponding to, the disclosed aspects of the exemplary embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

What is claimed is:

1. An antenna system, comprising:

a cylindrical reflector comprising a reflective surface and extending lengthwise along a first axis, the cylindrical reflector having a focal line;

at least one antenna feed element directed at the reflective surface;

a mechanical joint operable to rotate the cylindrical reflector about a second axis that is substantially parallel to the first axis to steer an electromagnetic beam output by the at least one antenna feed element in a direction perpendicular to the first or second axis;

wherein the at least one antenna feed element remains fixed relative to the rotation of the cylindrical reflector, such that the rotation of the cylindrical reflector does not cause movement of the at least one antenna feed element;

wherein the second axis is offset from the cylindrical reflector in front of the reflective surface;

wherein the second axis does not intersect the at least one antenna feed element;

wherein the position of the second axis relative to the focal line of the cylindrical reflector is configured such that the focal line moves relative to the at least one antenna feed element as the cylindrical reflector rotates; and wherein the position of the second axis is configured such that an effective focal length between the at least one antenna feed element and the reflective surface changes as the cylindrical reflector rotates.

2. The antenna system of claim 1, wherein the at least one antenna feed element comprises an array of feed horn antennas.

3. The antenna system of claim 2, wherein the array of feed horn antennas extends lengthwise along a third axis substantially parallel to the first axis and the second axis.

4. The antenna system of claim 1, wherein the at least one antenna feed element comprises a pillbox antenna.

5. The antenna system of claim 1, wherein the cylindrical reflector comprises a parabolic cylinder reflector.

6. The antenna system of claim 1, wherein the reflective surface is curved.

7. The antenna system of claim 1, wherein the cylindrical reflector acts to transform a spherical wave emanating from the at least one antenna feed element into a plane wave propagating in a direction substantially perpendicular to the first axis.

8. The antenna system of claim 1, further comprising a rotational mechanism for rotating the antenna system about a third axis perpendicular to the first axis, whereby the antenna system rotation is operable to steer the electromagnetic beam in a direction perpendicular to the third axis.

9. The antenna system of claim 8, wherein the rotational mechanism comprises a motorized turntable.

10. The antenna system of claim 8, wherein the rotational mechanism provides a 360 degree rotation of the antenna system.

11. The antenna system of claim 1, further comprising at least one reflector support member for rotatably coupling the cylindrical reflector, the at least one support member comprising a rack with teeth for engaging a gear rotated by a motor attached to the cylindrical reflector to rotate the cylindrical reflector about the second axis.

12. An antenna system, comprising:

a parabolic cylinder reflector comprising a reflective surface and extending lengthwise along a first axis, the parabolic cylinder reflector having a focal line;

a line source feed antenna pointed at the reflective surface and extending lengthwise along a second axis substantially parallel to the first axis to illuminate a substantial portion of the reflective surface; and rotating componentry configured to rotate the parabolic cylinder reflector about a third axis that is substantially parallel to the first axis to steer an electromagnetic beam output by the line source feed antenna in a direction perpendicular to the first axis;

wherein the line source feed antenna remains fixed relative to the rotation of the parabolic cylinder reflector, such that the rotation of the parabolic cylinder reflector does not cause movement of the line source feed antenna;

wherein the third axis is offset from the parabolic cylinder reflector in front of the reflective surface;

wherein the third axis does not intersect the line source feed antenna;

wherein the position of the third axis relative to the focal line of the parabolic cylinder reflector is configured such that the focal line moves relative to the at least one antenna feed element as the parabolic cylinder reflector rotates; and wherein the position of the third axis is configured such that an effective focal length between the at least one antenna feed element and the reflective surface changes as the parabolic cylinder reflector rotates.

13. The antenna system of claim 12, wherein the line source feed antenna comprises an array of feed horn antennas.

14. The antenna system of claim 12, wherein the line source feed antenna comprises a pillbox antenna.

15. The antenna system of claim 12, wherein the parabolic cylinder reflector acts to transform a spherical wave emanating from the line source feed antenna into a plane wave propagating in a direction substantially perpendicular to the first axis.

16. The antenna system of claim 12, further comprising second rotating componentry configured to rotate the antenna system about a fourth axis perpendicular to the first axis to steer the electromagnetic beam in a direction perpendicular to the first axis.

17. The antenna system of claim 16, wherein the second rotating componentry comprises a motorized turntable.

18. The antenna system of claim 16, wherein the second rotating componentry provides a 360 degree rotation of the antenna system.

19. The antenna system of claim 12, further comprising at least one reflector support member for rotatably coupling the parabolic cylinder reflector, the at least one support member comprising a rack with teeth for engaging a gear rotated by a motor attached to the parabolic cylinder reflector to rotate the parabolic cylinder reflector about the second axis.

20. A method for identifying an axis for rotating a reflector relative to at least one antenna feed element directed at a reflective surface of the reflector, the method comprising:

evaluating performance of the reflector at each of a plurality of reflector rotational axes positions based on a selected primary beam direction and during design of an antenna system, a first of the plurality of reflector rotational axes positions being distinct from a second of the plurality of reflector rotational axes positions in two dimensions, each evaluation comprising:

(a) positioning the reflector at one of the plurality of rotation axes positions based on the selected primary beam direction;

(b) rotating the reflector around the one of the plurality of rotation axes positions into a position to direct an electromagnetic beam in a beam direction based on the selected primary beam direction;

(c) emanating the electromagnetic beam in the direction;

(d) obtaining characteristics of the emanated beam; and (e) repeating (a) through (d) for a plurality of beam directions, wherein the plurality of beam directions includes the selected primary beam direction; and identifying one of the reflector rotational axes positions having improved performance relative to other ones of the reflector rotational axes positions for the selected primary beam direction and based on the obtained characteristics.

21. The method of claim 20, further comprising:

selecting the primary beam direction based on an application for an antenna system that the reflector and at least one antenna feed element is associated with;

configuring the at least one antenna feed element and the reflector based on the selected primary beam direction.

22. The method of claim 21, wherein the evaluation of the performance of the reflector at each of the plurality of reflector rotational axes positions is performed for a plurality of configurations of the at least one antenna feed element and the reflector.

23. The method of claim 20, wherein the reflector comprises a parabolic cylinder reflector.

24. A computer program product for identifying an axis for rotating a reflector relative to at least one antenna feed element directed at a reflective surface of the reflector, comprising:

a non-transitory computer-readable storage medium having computer-readable program code embodied therein, the computer-readable program code comprising:

computer-readable program code for evaluating performance of the reflector at each of a plurality of reflector rotational axes positions based on a selected primary beam direction and during design of an antenna system, a first of the plurality of reflector rotational axes positions being distinct from a second of the plurality of reflector rotational axes positions in two dimensions, each evaluation comprising:

(a) simulating an electromagnetic beam emanated by the reflector in each of a plurality of reflector positions along one of the reflector rotational axes positions based on the selected primary beam direction, each reflector position for directing an electromagnetic beam in a beam direction;

(b) estimating characteristics of the simulated beam; and (e) repeating (a) and (b) for a plurality of beam directions, wherein the plurality of beam directions includes the selected primary beam direction; and computer-readable program code for identifying one of the reflector rotational axes positions having improved performance relative to other ones of the reflector rotational axes positions for the selected primary beam direction and based on the estimated characteristics.

25. The computer program product of claim 24, further comprising:

computer-readable program code for selecting the primary beam direction based on an application for an antenna system that the reflector and at least one antenna feed element is associated with; and computer-readable program code for configuring the at least one antenna feed element and the reflector based on the selected primary beam direction.

26. The computer program product of claim 25, wherein the evaluation of the performance of the reflector at each of the plurality of reflector rotational axes positions is performed for a plurality of configurations of the at least one antenna feed element and the reflector.

27. The computer program product of claim 24, wherein the reflector comprises a parabolic cylinder reflector.

28. The antenna system of claim 1, wherein the second axis extends between a first pivot point and a second pivot point of the mechanical joint.

29. The antenna system of claim 12, wherein the third axis extends between a first pivot point and a second pivot point of the rotating componentry.

30. The method of claim 20, further comprising physically configuring the antenna system using the identified one of the reflector rotational axes positions having improved performance relative to other ones of the reflector rotational axes positions based on the obtained characteristics.

31. The computer program product of claim 24, wherein the identified one of the reflector rotational axes positions having improved performance relative to other ones of the reflector rotational axes positions based on the estimated characteristics is used to physically configure the antenna system.

* * * * *